US008325091B2

(12) United States Patent
Li et al.

(10) Patent No.: US 8,325,091 B2
(45) Date of Patent: Dec. 4, 2012

(54) DUAL-BAND ANTENNA

(75) Inventors: Ping Li, Shanghai (CN); Chong Zhang, Shanghai (CN); Cho-Ju Chung, Taipei Hsien (TW)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 393 days.

(21) Appl. No.: 12/758,032

(22) Filed: Apr. 12, 2010

(65) Prior Publication Data

US 2011/0187618 A1 Aug. 4, 2011

(30) Foreign Application Priority Data

Feb. 2, 2010 (CN) ..... 2010 2 0302141 U

(51) Int. Cl.
*H01Q 1/38* (2006.01)

(52) U.S. Cl. ..... 343/700 MS; 343/767

(58) Field of Classification Search ..... 343/700 MS, 343/767, 770
See application file for complete search history.

(56) References Cited

U.S. PATENT DOCUMENTS

| | | | | |
|---|---|---|---|---|
| 5,521,610 | A * | 5/1996 | Rodal | 343/797 |
| 6,762,723 | B2 * | 7/2004 | Nallo et al. | 343/700 MS |
| 6,788,254 | B2 * | 9/2004 | Oh et al. | 343/700 MS |
| 2003/0132885 | A1 * | 7/2003 | Kuramoto et al. | 343/702 |
| 2008/0268908 | A1 | 10/2008 | Chen | |
| 2009/0243940 | A1 * | 10/2009 | Humphrey | 343/700 MS |
| 2010/0164835 | A1 * | 7/2010 | Tai et al. | 343/906 |

* cited by examiner

*Primary Examiner* — Tho G Phan
(74) *Attorney, Agent, or Firm* — Altis Law Group, Inc.

(57) ABSTRACT

A dual-band antenna includes a feeding portion, a radiating portion, a grounding portion, and an insulating support portion. The insulating support portion includes a first support wall, a second support wall, and a third support wall. The third support wall is parallel to the substrate, and perpendicularly connected to the first support wall and the second support wall, to position the radiating portion.

7 Claims, 2 Drawing Sheets

DUAL-BAND ANTENNA

BACKGROUND

1. Technical Field

Embodiments of the present disclosure relate to antennas, and especially to a dual-band antenna.

2. Description of Related Art

Antennas are one important component of wireless communication devices, where performance and size of the antennas affect quality of the wireless communications devices. However, antennas are prone to deformation if squeezed or impacted during installation and usage. After deformation, radiation patterns of the antennas may be changed and/or unstable, and lead to adverse effects on signal reception.

It is therefore desirable to provide a new antenna which can overcome the above mentioned problems.

DETAILED DESCRIPTION

Figure 1:
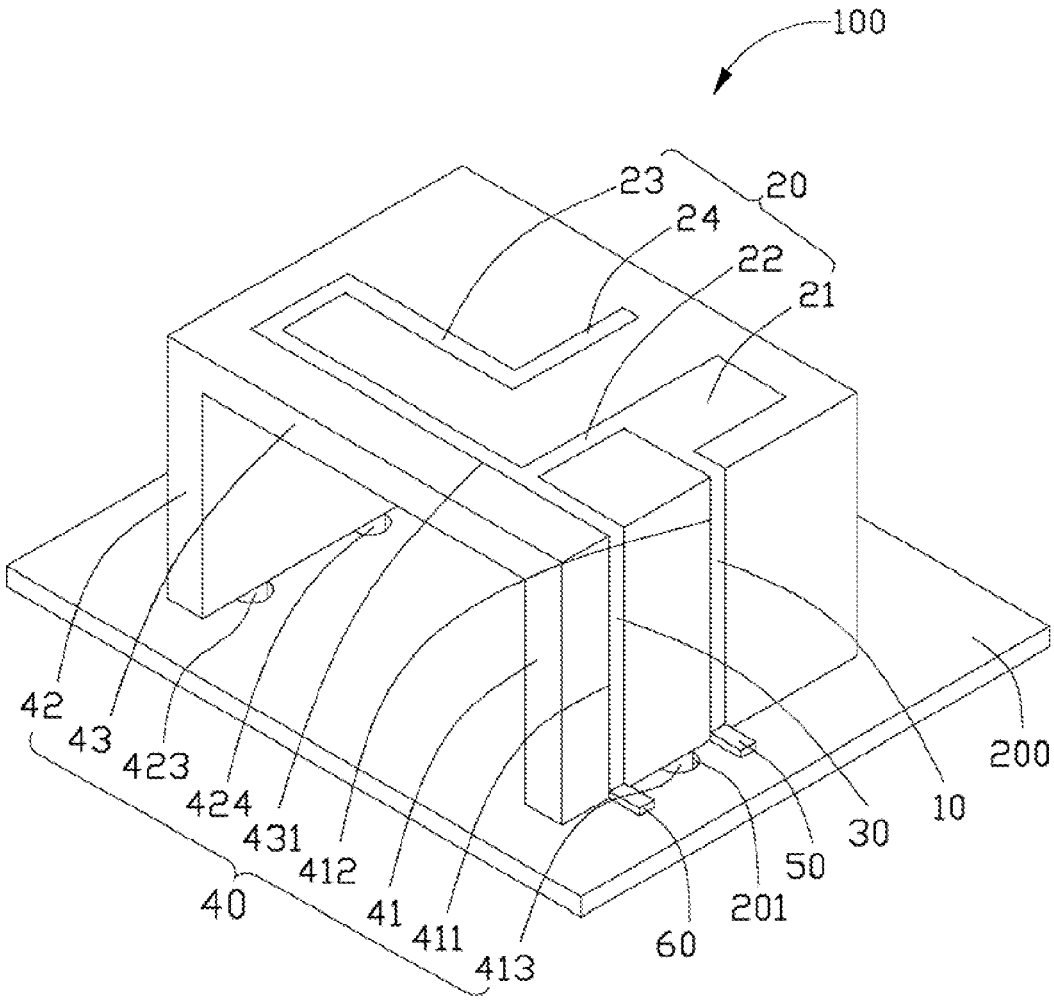
FIG. 1 is a schematic diagram of an embodiment of a dual-band antenna according to the present disclosure.
Figure 2:
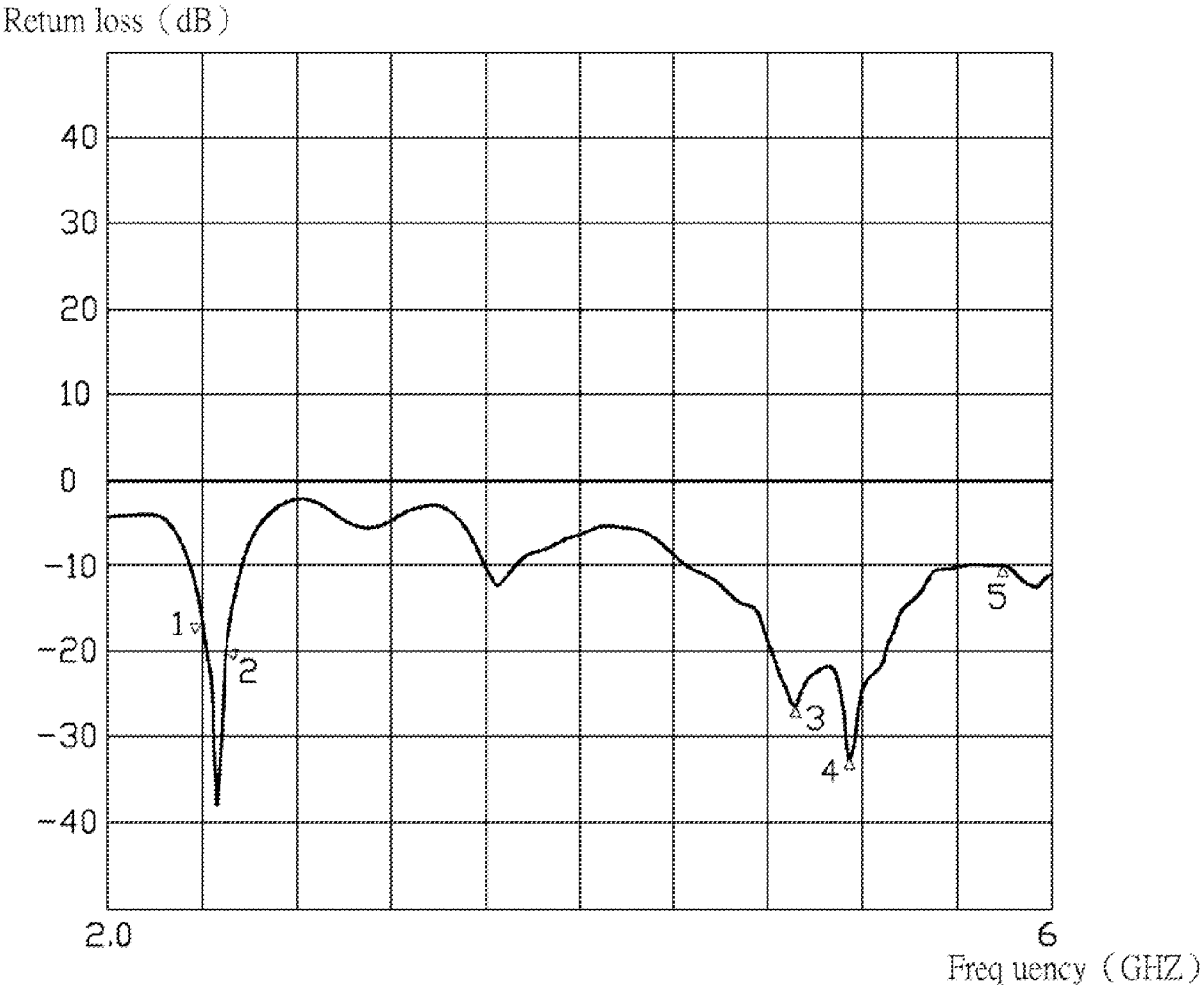
FIG. 2 is a graph showing an exemplary return loss of the dual-band antenna of FIG. 1.

Referring to FIG. 1, a schematic diagram of an embodiment of a dual-band antenna 100 as disclosed is shown. The dual-band antenna 100 is disposed on a substrate 200, and comprises a feeding portion 10, a radiating portion 20, a grounding portion 30, an insulating support portion 40, a matching connector 50, and a metal connector 60.

The insulating support portion 40 is made of a dielectric, such as plastic. In one embodiment, the insulating support portion 40 comprises a first support wall 41, a second support wall 42, and a third support wall 43. The first support wall 41 and the second support wall 42 are perpendicularly connected to the substrate 200. The third support wall 43 is parallel to the substrate 200, and perpendicularly connected to the first support wall 41 and the second support wall 42. In one embodiment, a shape and a location of the second support wall 42 may be adjustable.

The feeding portion 10 feeds electromagnetic signals. In one embodiment, the feeding portion 10 is in an inverted-L shape, and comprises a vertical feeding section on the first support wall 41 and a horizontal feeding section on the third support wall 43.

The matching connector 50 is positioned on the substrate 200, with one end connected to the feeding portion 10, and the other end connected to a feeding line or a feeding point laid on the substrate 200.

The grounding portion 30 is in an inverted-L shape, and comprises a vertical grounding section on the first support wall 41 and a horizontal grounding section on the third support wall 43.

The metal connector 60 is positioned on the substrate 200. The metal connector 60 comprises a first end connected to the grounding portion 30, and a second end connected to a metal layer of the substrate 200.

The radiating portion 20 is bent, and connected to the feed portion 10 and the grounding portion 30. In one embodiment, the radiating portion 20 is disposed on the third support wall 43. In one embodiment, the radiating portion 20 comprises a rectangular radiating section 21, a first L-shaped radiating section 22, a second L-shaped radiating section 23, and a suspended radiating section 24, connected in turn. In one embodiment, the feeding portion 10 is connected to the rectangular radiating section 21, and the grounding portion 30 is connected to a corner of the first L-shaped radiating section 22. In other embodiments, the radiating portion 20 may be other shapes.

The first support wall 41 and the third support wall 43 defines a feeding slot 412 having the same shape as the feeding portion 10, to accommodate and position the feeding portion 10. The first support wall 41 and the third support wall 43 further define a grounding slot 411 having the same shape as the grounding portion 30, to accommodate and position the grounding portion 30. The third support wall 43 defines a radiating slot 431 having the same shape as the radiating portion 20, to accommodate and position the radiating portion 20.

The insulating support portion 40 further comprises a plurality of support points, such as 413, 423, 424, configured on the first support wall 41 or the second support wall 42, and suitable to be inserted in the substrate 200. The number of the support points 413, 423, 424 is not less than three, to ensure stable connection to the substrate 200.

The insulating support portion 40 supports and positions the radiating portion 20, to prevent deformation from squeezing or impact, and maintain stable radiation patterns of the dual-band antenna 100.

In one embodiment, a length, a width, and a height of the insulating support portion 40 may be approximately 16 mm, 10 mm, and 7 mm. A radiating area of the radiating portion 20 may be approximately 160 mm^2, a thickness of the radiating portion 20 may be approximately 0.6 mm. In another example, the multiband antenna 100 can be designed with other dimensions.

Referring to FIG. 3, an exemplary return loss of the dual-band antenna 100 is shown. The frequency bands of the dual-band antenna 100 are tested from 2.0 GHz to 6.0 GHz. As shown, at a test point 1, the frequency band is 2.41 GHz, and the return loss is about −18.4 dB. At a test point 2, the frequency band is 2.48 GHz, and the return loss is about −27.4 dB. At a test point 3, the frequency band is 4.90 GHz, and the return loss is about −25.6 dB. At a test point 4, the frequency band is 5.14 GHz, and the return loss is about −38.2 dB. At a test point 5, the frequency band is 5.8 GHz, and the return loss is about −10.2 dB. Therefore, when the dual-band antenna 100 operates in the frequency bands from 2.4 GHz to 5 GHz, the return loss is less than −10 dB, in accordance with the industry standard.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A dual-band antenna, positioned on a substrate, the dual-band antenna comprising:

a feeding portion to feed electromagnetic signals;

a radiating portion connected to the feeding portion, to transceive electromagnetic signals;

a grounding portion connected to the radiating portion; and an insulating support portion, comprising:

a first support wall perpendicularly connected to the substrate;

a second support wall perpendicularly connected to the substrate and parallel to the first support wall; and a third support wall parallel to the substrate, and perpendicularly connected to the first support wall and the second support wall;

wherein the radiating portion is disposed on the insulated support portion and comprises a rectangular radiating section, a first L-shaped radiating section, a second L-shaped radiating section, and a suspended radiating section, connected in turn.

2. The dual-band antenna as claimed in claim 1, wherein the third support wall defines a radiating slot having the same shape as the radiating portion to accommodate and position the radiating portion.

3. The dual-band antenna as claimed in claim 1, wherein the first support wall and the third support wall collectively define a feeding slot having the same shape as the feeding portion to accommodate and position the feeding portion.

4. The dual-band antenna as claimed in claim 3, wherein the first support wall and the third support wall defines a feeding slot having the same shape as the feeding portion, to accommodate and position the feeding portion.

5. The dual-band antenna as claimed in claim 3, wherein the grounding portion is in an inverted-L shape, and comprises a vertical feeding section laid on the first support wall and a horizontal feeding section laid on the third support wall.

6. The dual-band antenna as claimed in claim 5, wherein the first support wall and the third support wall defines a grounding slot having the same shape as the grounding portion, to accommodate and position the grounding portion.

7. The dual-band antenna as claimed in claim 1, wherein the insulated support portion further comprises a plurality of support points, configured on the first support wall or the second support wall and suitable to be inserted in the substrate.

* * * * *